US005649597A

United States Patent [19]

Ringgenberg

[11] Patent Number: 5,649,597

[45] Date of Patent: Jul. 22, 1997

[54] DIFFERENTIAL PRESSURE TEST/BYPASS VALVE AND METHOD FOR USING THE SAME

[75] Inventor: Paul D. Ringgenberg, Carrollton, Tex.

[73] Assignee: Halliburton Company, Dallas, Tex.

[21] Appl. No.: 502,451

[22] Filed: Jul. 14, 1995

[51] Int. Cl.[6] ..... E21B 43/12

[52] U.S. Cl. ..... 166/373; 166/320

[58] Field of Search ..... 166/373, 336, 166/320, 317, 264, 250.17

[56] References Cited

U.S. PATENT DOCUMENTS

| | | | |
|---|---|---|---|
| 3,385,370 | 5/1968 | Knox et al. | 166/325 X |
| 3,698,411 | 10/1972 | Garrett | 166/325 X |
| 3,973,587 | 8/1976 | Cochran | 137/496 |
| 4,063,593 | 12/1977 | Jessup | 166/317 |
| 4,083,409 | 4/1978 | Barrington | 166/320 |
| 4,595,060 | 6/1986 | Beck | 166/373 |
| 4,617,999 | 10/1986 | Beck | 166/372 |
| 4,694,903 | 9/1987 | Ringgenberg | 166/250 |
| 4,915,171 | 4/1990 | McMahan | 166/264 |
| 4,962,819 | 10/1990 | Bailey et al. | 175/218 |
| 5,193,621 | 3/1993 | Manke et al. | 166/386 |
| 5,484,022 | 1/1996 | Coutte et al. | 166/336 |

*Primary Examiner*—Frank Tsay

*Attorney, Agent, or Firm*—William M. Imwalle; Daniel F. Perez

[57] ABSTRACT

A well tool apparatus (40) comprising a tubular housing (56) and operating mandrel (58) each having autofill ports (74, 76) and bypass ports (128, 130) therein. The well tool apparatus (40) also comprising a normally closed ball valve (96) rotatably disposed within the operating mandrel (58) preventing communication between the upper section (104) and the lower section (106) of the operating mandrel (58) such that internal pressure above the ball valve (96) greater than internal pressure below the ball valve (96) downwardly urges the operating mandrel (58) allowing pressure testing of the pipe string (32) above the ball valve (96) and such that internal pressure below the ball valve (96) greater than internal pressure above ball valve (96) upwardly urges the operating mandrel (58). The well tool (40) further comprising a lower mandrel (150) disposed within the tubular housing (56) below the operating mandrel (58) that communicates with the well bore (16) through rupture disk port (174) such that sufficient well bore pressure will upwardly urge the lower mandrel (150) allowing operating mandrel (58) to slide downward relative to the tubular housing (56) and lock therein.

35 Claims, 10 Drawing Sheets

DIFFERENTIAL PRESSURE TEST/BYPASS VALVE AND METHOD FOR USING THE SAME

TECHNICAL FIELD OF THE INVENTION

This invention relates in general to a valve apparatus used in a string of tubing or drill pipe disposed in a well bore, and in particular to, a new and improved type of tubing tester valve having bypass valve capabilities which may be incorporated in a string of tubing or drill pipe for pressure testing the integrity of the tubing or drill pipe.

BACKGROUND OF THE INVENTION

During the course of drilling an oil or gas well, one operation which is often performed is to lower a testing string into the well to test the production capabilities of a hydrocarbon producing underground formation intersected by the well. This test is accomplished by a lowering a string of pipe, commonly referred to as the drill pipe, into the well, with the formation tester valve attached. Another typical tool run into the well is known as a Tubing String Testing Valve (TST), which is a full opening test valve that allows the drill stem test string to be pressure tested while running in the hole. It is desirable prior to conducting a drill stem test, to be able to pressure test the string of drill pipe periodically to determine whether there is any leakage at the joints between successive stands of pipe. To accomplish this drill pipe pressure testing, the pipe string is filled with a fluid and the lowering of the pipe is periodically stopped. When the lowering of the pipe is stopped, the fluid in the string of the drill pipe is pressurized to determine whether there are any leaks in the drill pipe above the TST valve.

In the past, a number of devices have been used to test the pressure integrity of pipe strings. In some instances, pressure is applied against a closed formation tester valve included in the string. In other instances, a tubing tester valve is employed in the string near the packer, and pressure is applied against the valve element in the tubing tester valve.

It is necessary to fill the tubing or drill pipe string with an incompressible fluid as the string is run into the well bore before applying pressure to the interior of the string. In the past, tubing tester valves, when used in a string without a closed formation tester valve therebetween, relied upon the upward biasing of a flapper valve element to allow the test sting to fill with fluid. The flapper valve is biased against a spring by hydrostatic pressure below the tubing tester valve in the test string to gradually fill the test string from below, generally drilling "mud." In other instances, the test string is filled from the top on the rig floor with diesel oil or other fluids. Such a procedure, however, is time consuming and hazardous. Still other tubing tester valves incorporate a closeable bypass port below the valve element so that, even with a closed formation tester valve below, well fluids in the annulus surrounding the test string can enter the vicinity of the tubing tester valve and bias a valve element therein to an open position through hydrostatic pressure, thereby filling the drill string.

At some point during the well service operation, be it cementing, treating, or testing, it is necessary to be able to open the tubing tester valve so that flow from the rig floor down into the formation, which would normally close the valve, may be affected. Tubing tester valves accommodate this necessity in several ways. Some valves provide an opening of the tubing tester valve through a reciprocating and/or rotating the pipe string. Other valves provide for the opening of the valve through a valve actuator operated responsive to an increase in annular pressure.

Once the test string is run to its desired depth, it is necessary to sting, via a set of seals located on the bottom of the test string, into a production packer. If it is necessary, however, to pull the test string up, the TST flapper valve will act as a check valve, thereby causing a pressure decrease due to an increase in volume in the annulus below the TST flapper valve. This decrease in pressure can operate to damage the seals on the bottom of the test string, as well as operate the TST valve itself.

If one of the other tester valves located in the test string have been closed for testing reasons, the pulling in and out of the seals can actually destroy the seal integrity on the stinger of the test string as well as affecting the test string in the production packer, by causing a piston effect due to the closed annulus area.

In the past, bypass valves were not commonly used with TST valves. In the cases where bypass valves are used in conjunction with TST valves, two separate tools must be used.

Therefore, a need has arisen for a well tool apparatus that is capable of supporting a tubing pressure test thereabove, while avoiding damage to production valves and trash build-up in the pressure test valve, and that is capable of allowing the tubing string to sting into and out of production packers avoiding damage to the seal assembly and premature operation of the pressure test valve.

SUMMARY OF THE INVENTION

The present invention disclosed herein comprises a well tool apparatus that features both a tubing pressure testing capability and a bypass capability. The well tool apparatus comprises a tubular housing having an upper portion defining at least one autofill port and a lower portion defining at least one bypass port. An operating mandrel is slidably disposed within the tubular housing. The operating mandrel has an upper section defining at least one autofill port and a lower section defining at least one bypass port. A ball valve is rotatably disposed within the operating mandrel below the autofill ports and above the bypass ports. The ball valve is normally closed so that no internal communication between the upper section of the operating mandrel and the lower section of the operating mandrel can occur. Fluid from the well bore passes through the autofill ports to fill up the drill string above the ball valve as the tool is run into the hole. The drill string above the ball valve can then be pressurized in order to test the integrity of the drill string. When the drill string is pressurized above the ball valve, the operating mandrel slides downwardly relative to the tubular housing. When the operating mandrel slides downward, the autofill ports in the operating mandrel move out of communication with the autofill ports in the tubular housing.

When pressure is released from above the ball valve, a piston slides upward placing the bypass ports of the tubular housing in communication with the bypass ports of the operating mandrel. After the drill string runs further into the hole, hydrostatic pressure from the well bore will increase causing pressure to build up below the ball valve. When sufficient pressure builds up below the ball valve, the operating mandrel slides upwardly relative to the tubular housing placing the autofill ports in the operating mandrel in selective communication with the autofill ports in the tubular housing.

A lower mandrel is slidably disposed within the lower portion of the tubular housing below the bypass ports. When pressure is applied to the well bore, the lower mandrel slides upward relative to the tubular housing, placing an air chamber in communication with an oil discharge port allowing high pressure oil from an oil chamber to discharge into the atmospheric air chamber thereby activating the operating mandrel to slide downwardly relative to the tubular housing. Activating the operating mandrel places the autofill ports of the tubular housing and the autofill port operating mandrel permanently out of communication, places the bypass ports of the operating mandrel and the bypass ports of tubular housing permanently out of communication, rotates the ball valve to an open position and locks the operating mandrel in place within the tubular housing thereby creating a blank pipe.

BRIEF DESCRIPTION OF THE DRAWINGS

For a more complete understanding of the present invention, including its features and advantages, reference is now made to the detailed description, taken in conjunction with the accompanying drawings of which:

FIG. 8, including

FIG. 9, including FIG. 10, including

DETAILED DESCRIPTION OF THE INVENTION

The well tool of the present invention comprises a tubular housing having an operating mandrel slidably disposed therein, a normally closed ball valve rotatably disposed within the operating mandrel, a means for downwardly urging the operating mandrel relative to the tubular housing, a means for upwardly urging the operating mandrel relative to the tubular housing, and a means for activating the operating mandrel such that the operating mandrel slides downwardly relative to the tubular housing and the ball valve is rotated to an open position thereby creating a blank pipe.

Figure 1:
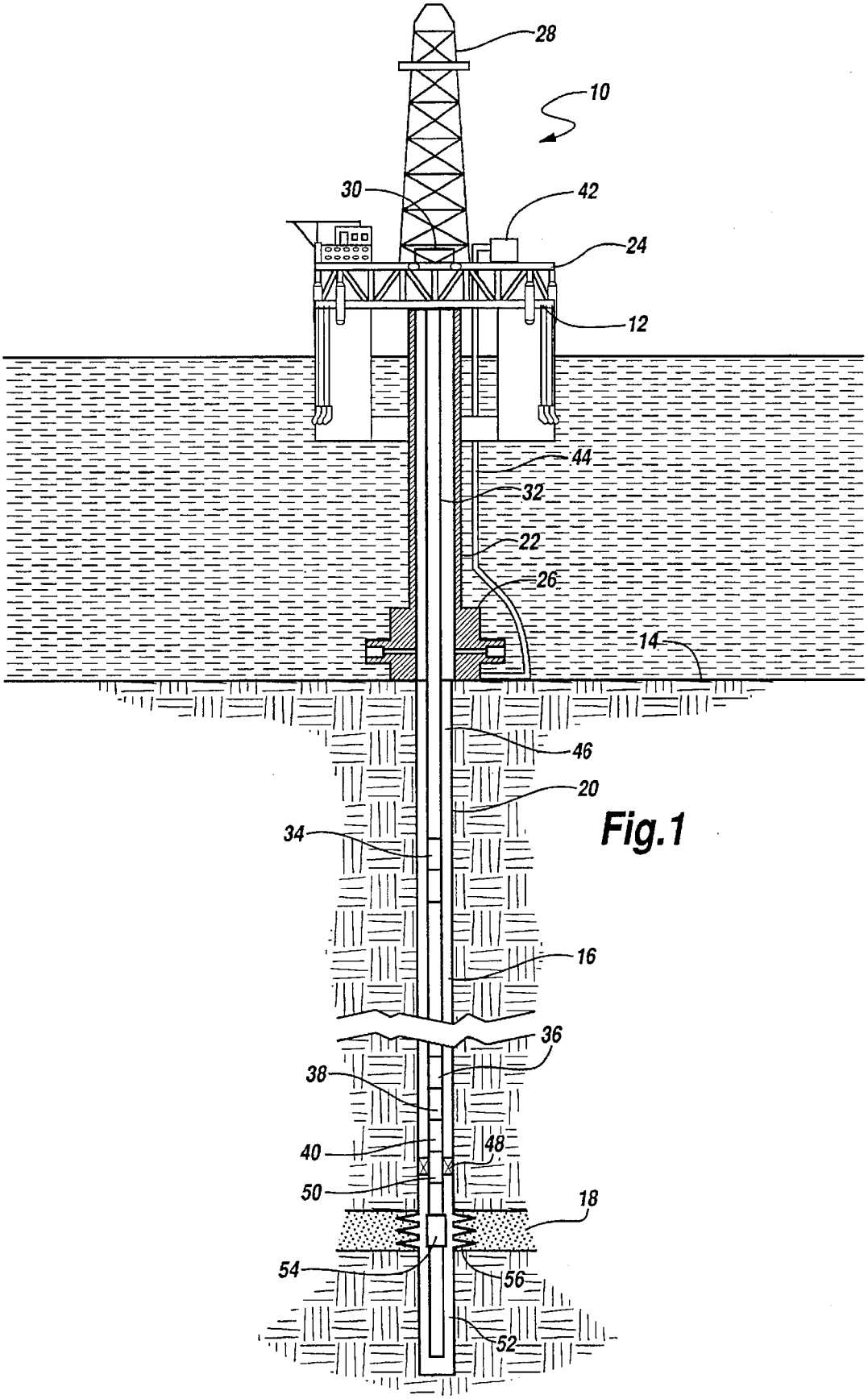
FIG. 1 is a schematic illustration of a well test string for an offshore well in which the tubing tester valve of the present invention may be disposed.

Referring to FIG. 1 of the present invention, a testing string for use in an offshore oil or gas well is schematically illustrated. In FIG. 1, the offshore system is generally designated 10. A floating work station 12 is centered over a submerged oil or gas well located in the sea floor 14 having a well bore 16 which extends from the sea floor 14 to a submerged formation 18 to be tested. The well bore 16 is typically lined by steel casing 20 cemented into place. A subsea conduit 22 extends from the deck 24 of the floating work station 12 into a well head installation 26. The floating work station 12 has a derrick 28 and a hoisting apparatus 30 for raising and lowering tools to drill, test, and complete the oil or gas well.

A testing string 32 is being lowered in the well bore 16 of the oil or gas well. The testing string includes such tools as one or more pressure balanced slip joints 34 to compensate for the wave action of the floating work station 12 as the testing string is being lowered into place, and circulation valve 36, a tester valve 38, and the differential pressure test/bypass valve of the present invention 40.

The slip joint 34 may be similar to that described in U.S. Pat. No. 3,354,950 to Hyde. The circulation valve 36 is preferably of the annulus pressure responsive type and may be as described in U.S. Pat. Nos. 3,850,250 or 3,970,147. The circulation valve 36 may also be reclosable type as described in U.S. Pat. No. 4,113,012 to Evans, et al.

The tester valve 38 is preferably of the type disclosed in U.S. Pat. No. 4,429,748 although other annulus pressure responsive tester valves as known in the art may be employed. A differential pressure test/bypass valve 40 is described in the present invention.

The tester valve 38, circulation valve 36, and differential pressure test/bypass valve 40 are operated by fluid annulus pressure exerted by pump 42 on the deck of the floating work station 12. Pressure changes are transmitted by a pipe 44 to the well annulus 46 between the casing 20 and the testing string 32. Well annulus pressure is isolated from the formation 18 to be tested by a packer 48 set in the well casing 20 just above the formation 18. The packer 48 may be a Baker Oil Tools Model D Packer, the Otis type W Packer, the Halliburton Services EZ Drill® SV Packer or other packers well known in the well testing art.

The testing string 32 includes a tubing seal assembly 50 at the lower end of the testing string which stings into or stabs through a passageway through the production packer 48 for forming a seal isolating the well annulus 46 above the packer 48 from an interior bore portion 52 of the well immediately adjacent the formation 18 and below the packer 48.

Differential pressure test/bypass valve 40 relieves pressure built up in testing string 32 below tester valve 38 as seal assembly 50 stabs into packer 48.

A perforating run 54 may be run via wire line to or may be disposed on a tubing string at the lower end of testing string 32 to form perforation 56 in casing 20, thereby allowing formation fluids to flow from the formation 18 into the flow passage of the tubing string 32 via perforations 56 by way of a port **54*a*. Alternatively, the casing 20 may have been perforated prior to running testing string 32 into the well bore 16**.

A formation test controlling the flow of fluid from the formation 18 through the flow channel in the testing string 32 by applying and releasing fluid annulus pressure to the well annulus 46 by pump 42 to operate circulation valve 36, tester valve 38, and differential test/bypass valve 40, and measuring the pressure build up curves and fluid temperature curves with appropriate pressure and temperature sensors in the testing string 32 as is fully described in the aforementioned patent.

It should be understood, that the differential pressure test/bypass valve 40 of the present invention is not limited to use in a testing string as shown in FIG. 1, or even to use in well testing per se. For example, the differential pressure test/bypass valve 40 of the present invention may be employed in a drill stem test wherein no other valve, or fewer valves than are shown in FIG. 1 are employed. In fact, the valve of the present invention may be employed in a test wherein all pressure shut-offs are conducted on the surface at the rig floor, and no "formation tester" valves are used at all. Similarly, in a cementing, acidizing, fracturing, or other well service operation, the differential pressure test/bypass valve 40 of the present invention may be employed whenever it is necessary or desirable to assure the pressure integrity of a string of tubing or drill pipe.

Figure 2:
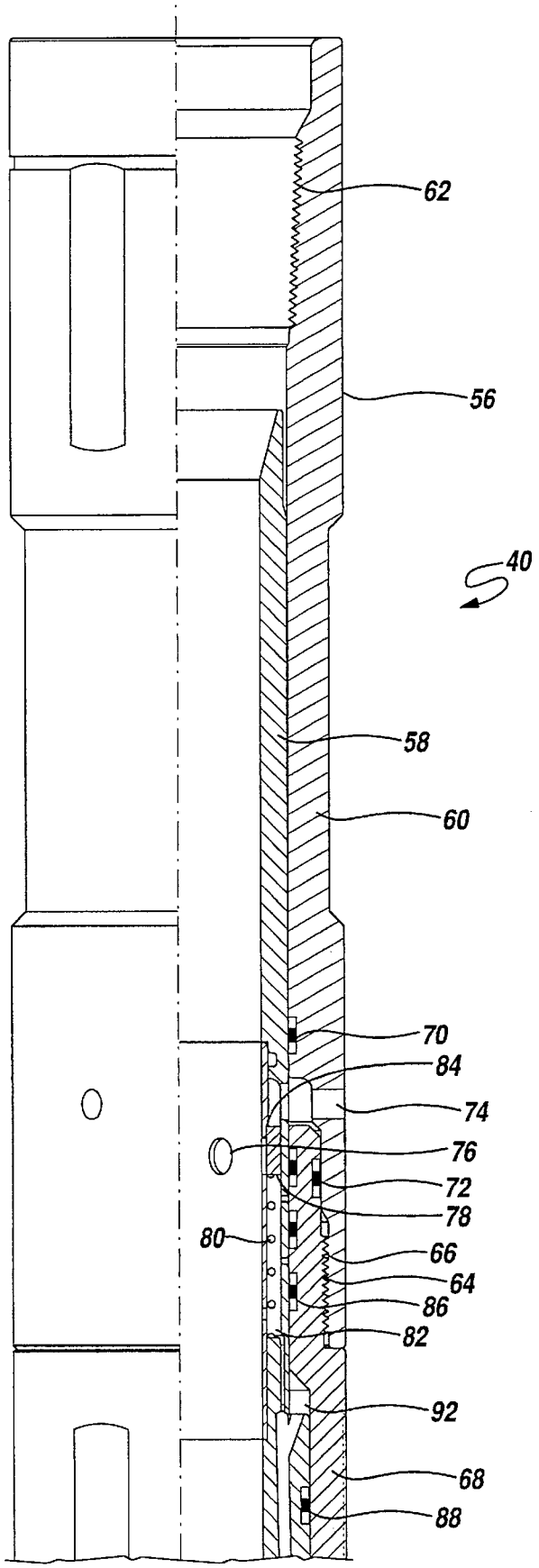
FIG. 2 is a horizonal quarter-section elevation of the top section of the differential pressure test/bypass valve of the present invention.

Referring initially to FIG. 2, the top portion of the well tool assembly is depicted. The well tool assembly is generally designated as 40. Well tool assembly 40 comprises a tubular housing 56 and an operating mandrel 58 disposed within tubular housing 56. Tubular housing 56 comprises a first tubular section 60 having upper internal threads 62 and lower internal threads 64. Upper internal threads 62 threadably engage another well tool (not pictured) or a drill stand (not pictured). Lower internal threads 64 of first tubular section 60 threadably engage upper threads 66 of second tubular section 68.

Between tubular housing 56 and operating mandrel 58 is an elastomeric member commonly referred to as an O-ring 70. O-ring 70 creates a seal between tubular housing 56 and operating mandrel 58. O-ring 72 creates a seal between first tubular section 60 and second tubular section 68.

First tubular section 60 defines at least one autofill port 74. Operating mandrel 58 defines at least one autofill port 76. Autofill ports 74 are selectively in communication with autofill ports 76 allowing well bore fluid to pass from the well bore to the internal portion of well tool apparatus 40. Check valve 78 is disposed within chamber 82 of operating mandrel 58. Check valve 78 is biased by spring 80 against shoulder 84. Check valve 78 is opened when the pressure in the well bore is higher than the pressure inside operating mandrel 58. Check valve 78 seats against shoulder 84 when the pressure inside operating mandrel 58 is greater than or equal to the well bore pressure. A plurality of O-rings 86 seal operating mandrel 58 and second tubular section 68. O-ring 88 also seals operating mandrel 58 and second tubular section 68.

Figure 3:
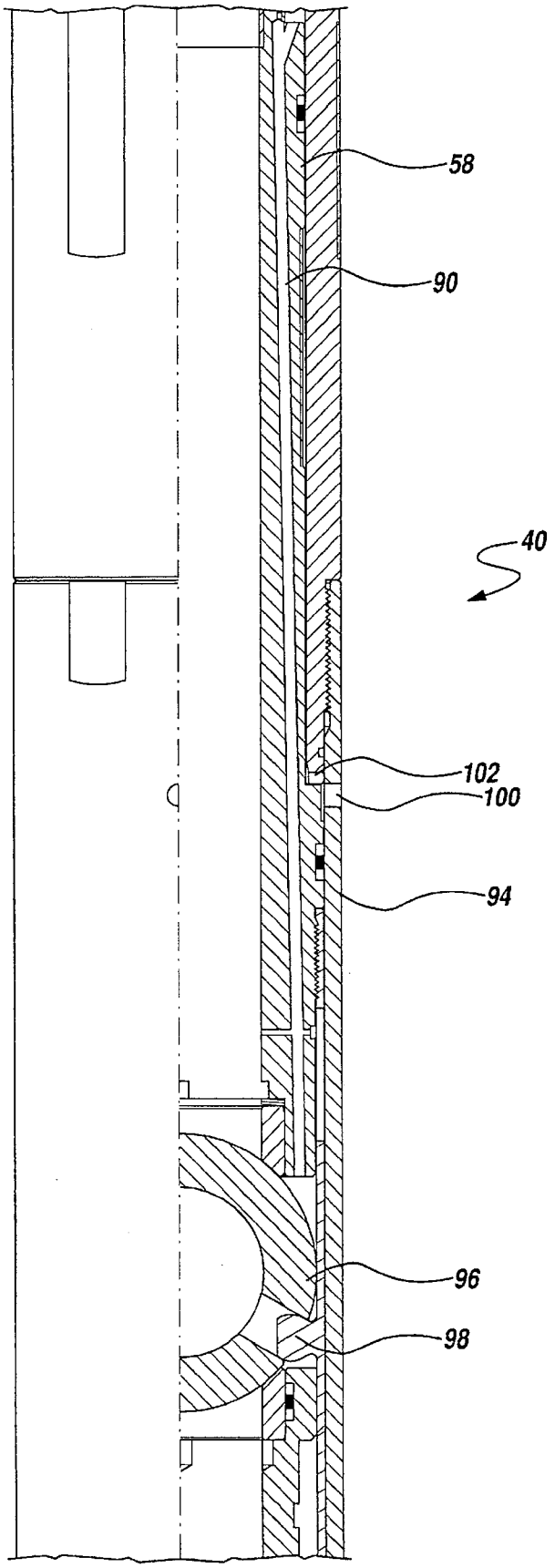
FIG. 3 is a horizonal quarter-section elevation of an upper section of the differential pressure test/bypass valve of the present invention.

Now referring to FIG. 3, a drawing representing a section of well tool apparatus 40, operating mandrel 58 defines upper passage way 90 which provides communication between upper shoulder 92 (see FIG. 2)of second tubular section 68 and the internal portion of well tool apparatus 40. Second tubular section 68 threadably connects with third tubular section 94. Ball valve 96 is disposed within operating mandrel 58. Ball valve operator 98 rotates ball valve 96 when operating mandrel 56 slides downwardly a sufficient distance relative to tubular housing 58. Surface test ports 100 provides communication between the well bore and lower shoulder 102 of operating mandrel 58 to urge operating mandrel 58 downward relative to tubular housing 56.

Figure 4:
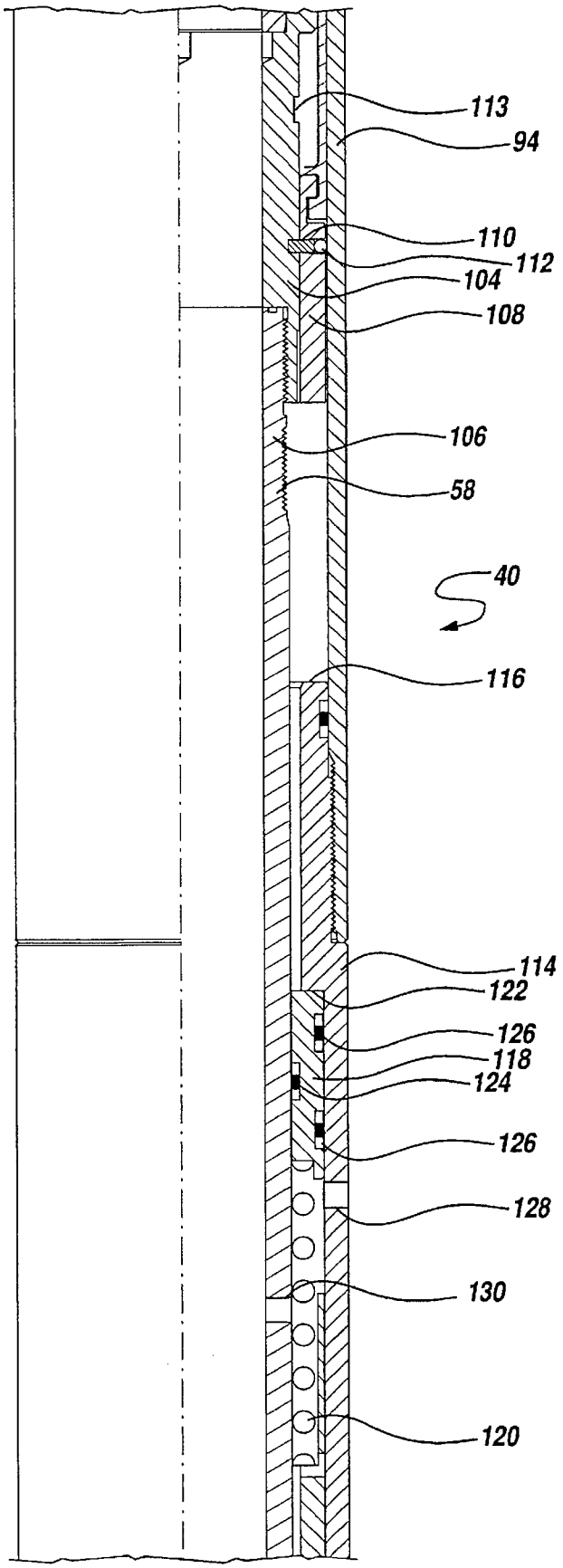
FIG. 4 is a horizonal quarter-section elevation of an upper-central section of the differential pressure test/bypass valve of the present invention.

Now referring to FIG. 4, a drawing representing a section of well tool apparatus 40, operating mandrel 58 comprises upper section 104 and lower section 106. Operating mandrel 58 also comprises shear pin holder 108, a plurality of shear pins 110 biased by a spring 112 and a shear pin receiver 113A. Third tubular section 94 is threadably engaged with fourth tubular section 114. Fourth tubular section 114 has a upper shoulder 116. Piston 118 is disposed between fourth tubular section 114 and lower section 106 of operating mandrel 58. Piston 118 is upwardly biased by spring 120 against upper shoulder 122. O-ring 124 provides a seal between piston 118 and operating mandrel 58. A plurality of O-rings 126 provides a seal between piston 118 and fourth tubular section 114.

Fourth tubular section 114 defines at least one bypass port 128. Lower section 106 of operating mandrel 58 defines at least one bypass port 130. Bypass ports 128 are in selective communication with bypass ports 130.

Figure 5:
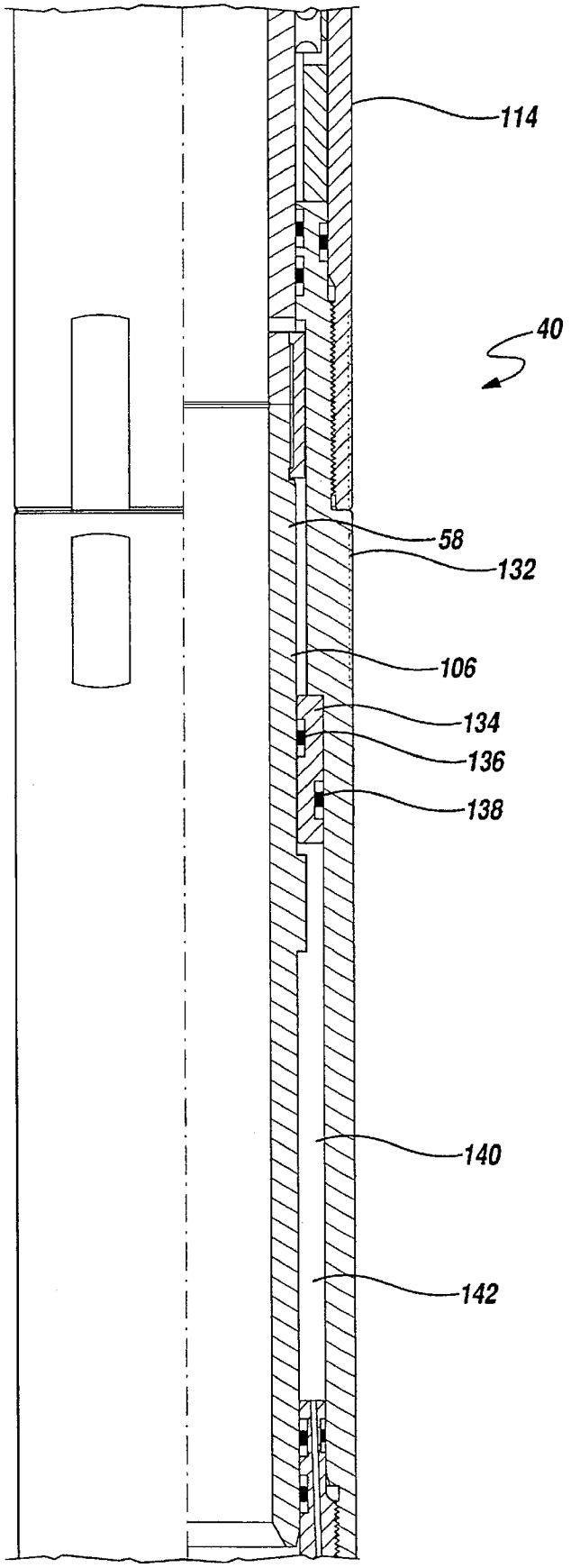
FIG. 5 is a horizonal quarter-section elevation of a central section of the differential pressure test/bypass valve of the present invention.

Now referring to FIG. 5, a drawing representing a section of oil tool apparatus 40, fourth tubular section 114 is threadably connected with fifth tubular section 132. Piston 134 is disposed between fifth tubular section 132 and lower section 106 of operating mandrel 58. O-ring 136 provides a seal between piston 134 and operating mandrel 58. O-ring 138 provides a seal between piston 134 and fifth tubular section 132. Oil chamber 140 is disposed between fifth tubular section 132 and lower section 106 of operating mandrel 58. Oil chamber 140 selectively contains high pressure oil 142.

Figure 6:
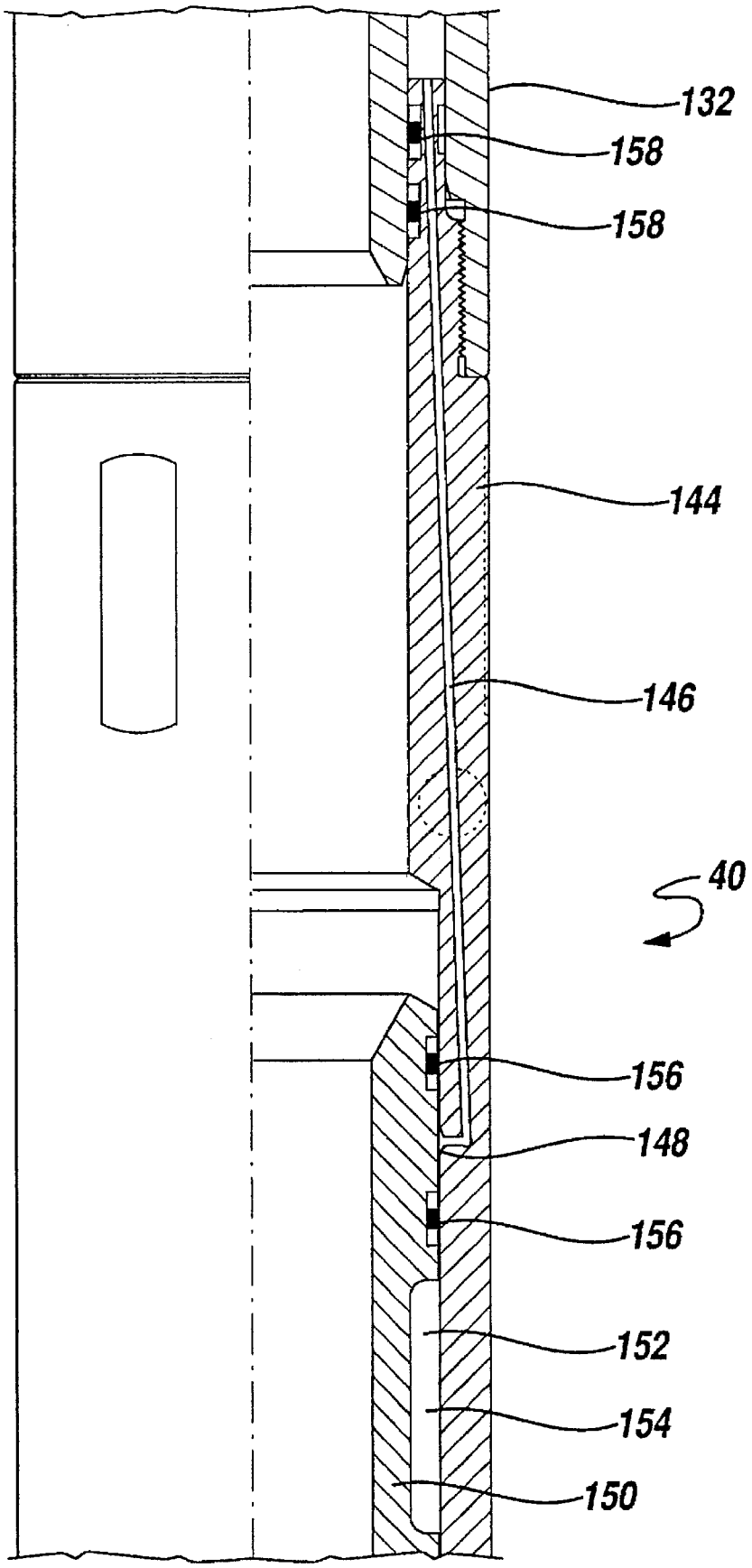
FIG. 6 is a horizonal quarter-section elevation of a lower section of the differential pressure test/bypass valve of the present invention.

Now referring to FIG. 6, a drawing representing a section of oil tool apparatus 40, fifth tubular section 132 threadably connects with sixth tubular section 144. Lower internal passageway 146 is disposed within sixth tubular section 144. Lower internal passageway 146 terminates in oil discharge port 148. Lower mandrel 150 is disposed within sixth tubular section 144. Atmospheric air chamber 152 is disposed between lower mandrel 150 and sixth tubular section 144. Contained within atmospheric air chamber 152 is atmospheric air 154. A plurality of O-rings 156 provides a seal between lower mandrel 150 and sixth tubular section 144. A plurality of O-rings 158 provides a seal between sixth tubular section 144 and operating mandrel 58.

Figure 7:
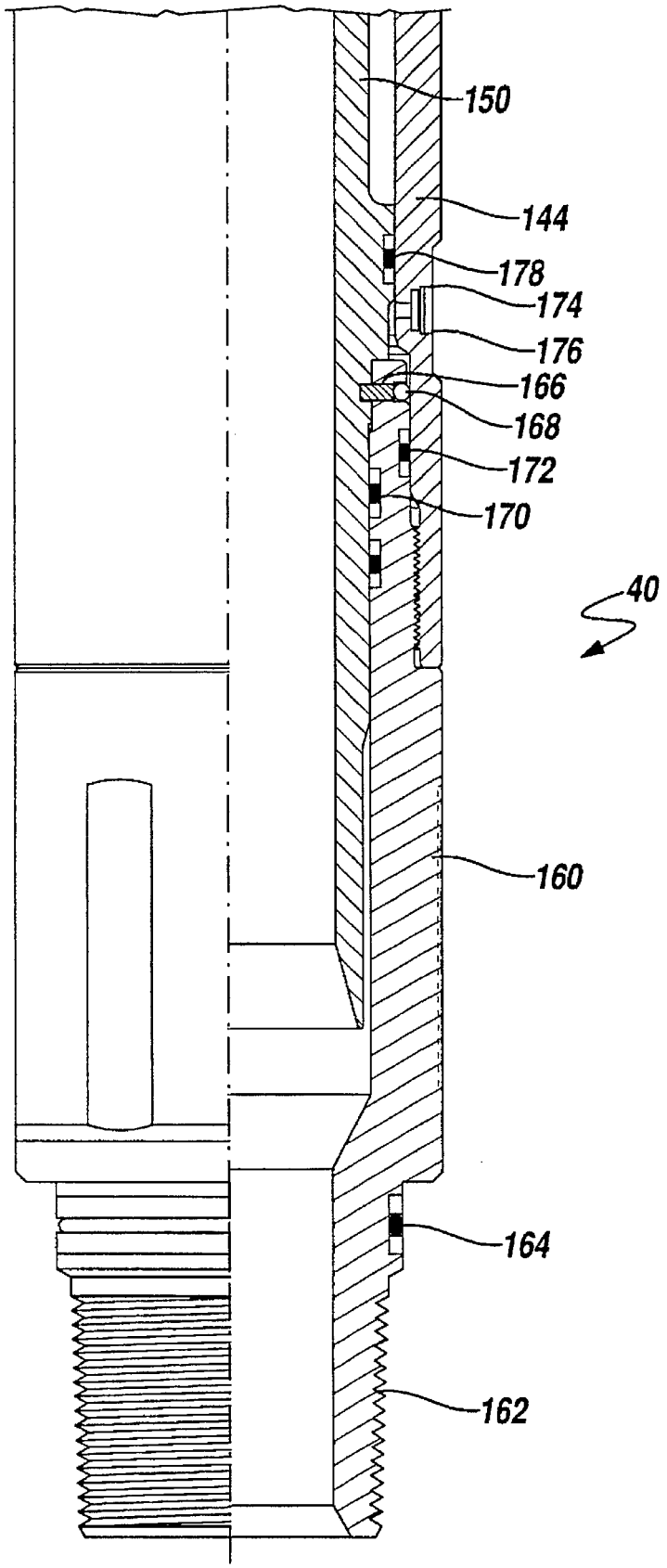
FIG. 7 is a horizonal quarter-section elevation of the bottom section of the differential pressure test/bypass valve of the present invention.

Now referring to FIG. 7, a drawing representing a section of well tool apparatus 40, sixth tubular section 144 threadably connects with lower nipple 160 having outer threads 162 on the end opposite sixth tubular section 144. Outer threads 162 threadably engage with another tool (not pictured) or work string (not pictured). O-ring 164 provides a seal between lower nipple 160 and another tool (not pictured). A plurality of shear pins 166 are disposed between lower mandrel 150 and lower nipple 160. A spring 168 bias shear pins 166. A plurality of O-rings 170 create a seal between lower nipple 160 and lower mandrel 150. O-ring 172 provides a seal between lower nipple 160 and sixth tubular section 144. Sixth tubular section 144 defines rupture disk port 174. Rupture disk 176 is disposed within rupture disk port 174. O-ring 178 provides a seal between lower mandrel 150 and sixth tubular section 144. Lower mandrel 150 comprises a plurality of upper shoulders 180, 182, 184 and a plurality of lower shoulders 186.

OPERATION OF THE PREFERRED EMBODIMENTS

Figure 8A:
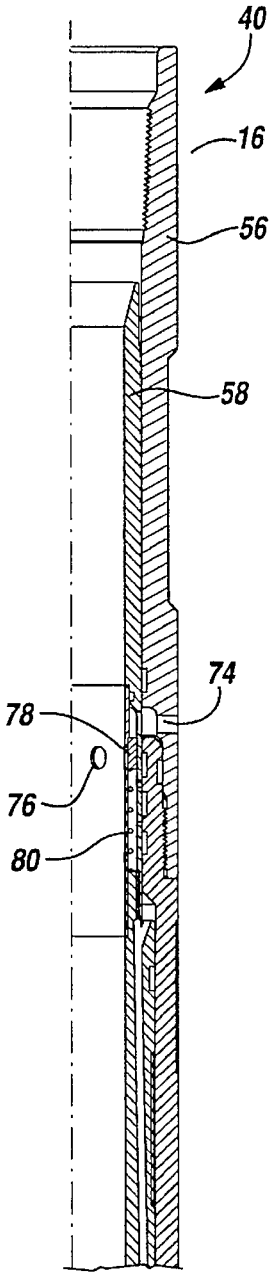
FIGS. 8A–8C, is a quarter-section elevation of a section of the differential pressure test/bypass valve of the present invention in three positions.
Figure 8B:
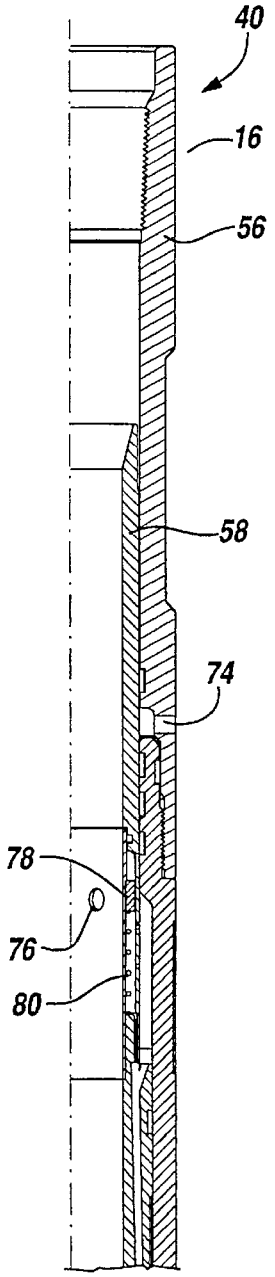
Figure 8C:
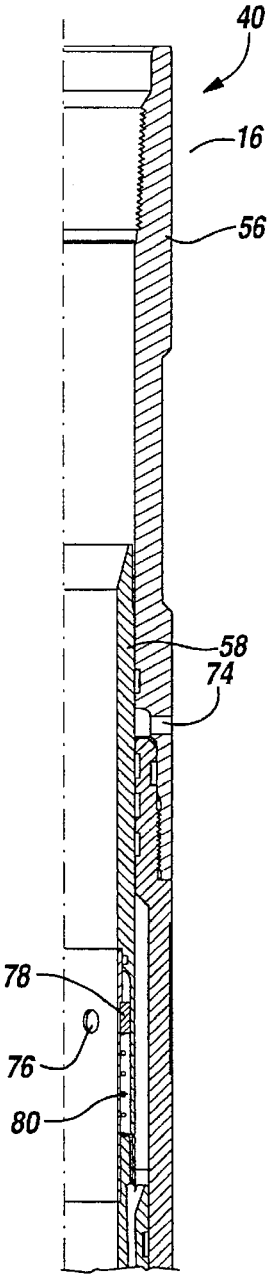
Figure 9A:
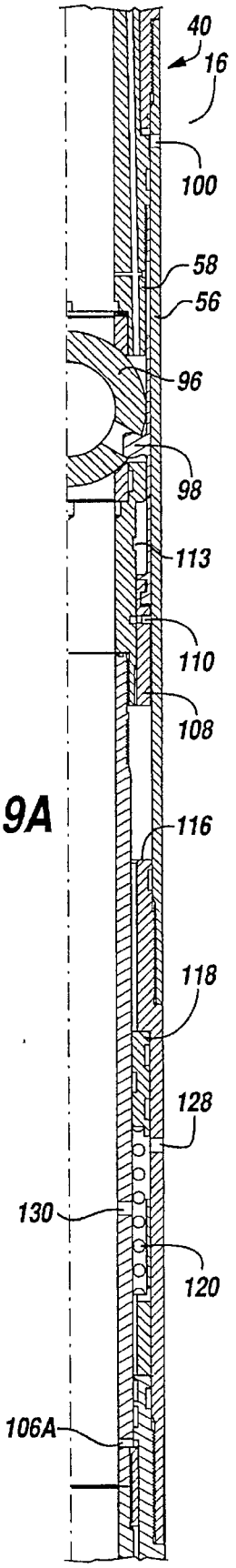
FIGS. 9A–9C, is a quarter-section elevation of a section of the differential pressure test/bypass valve of the present invention in three positions.
Figure 9B:
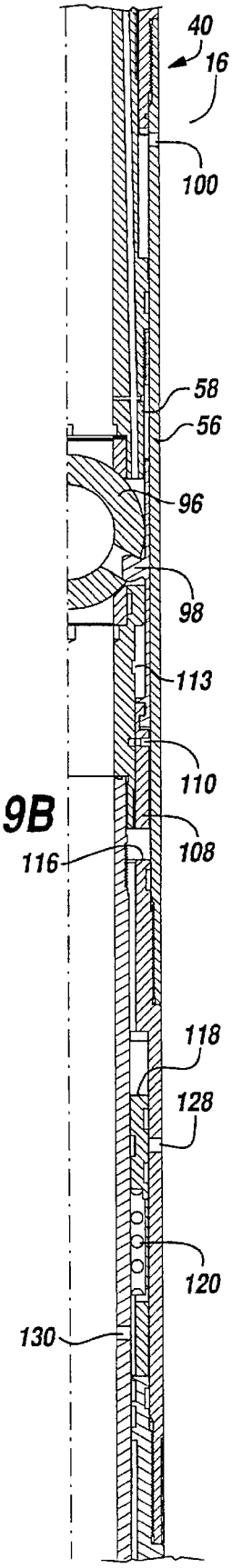
Figure 9C:
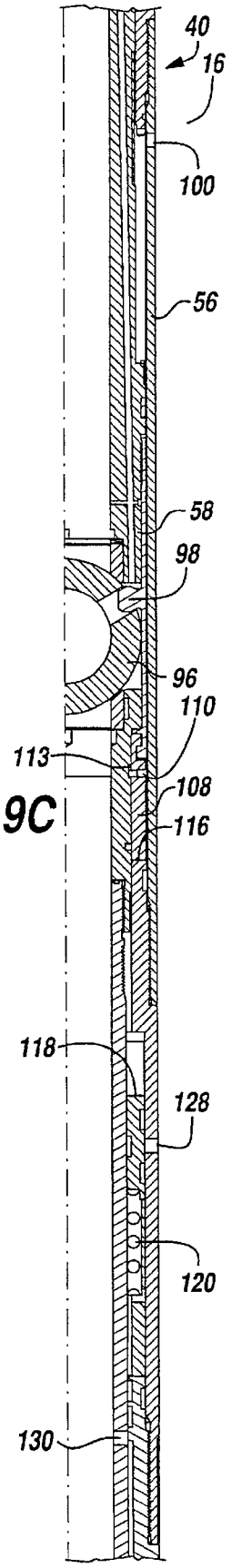
Figure 10A:
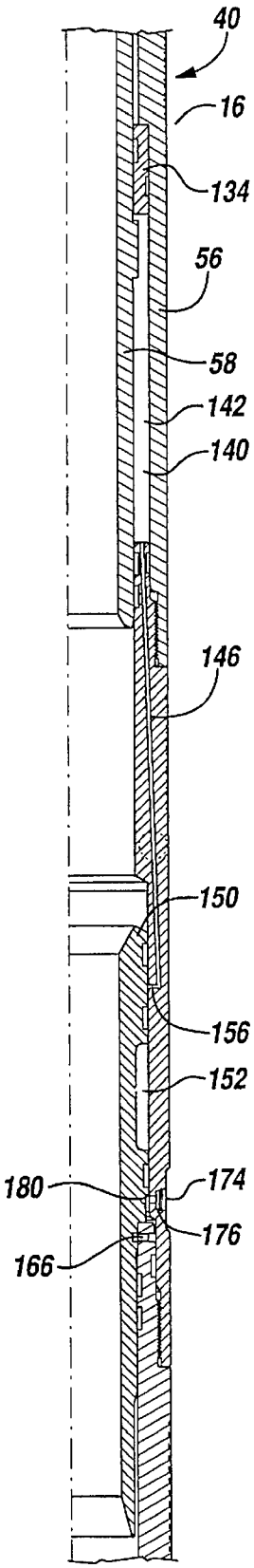
FIGS. 10A–10C, is a quarter-section elevation of a section of the differential pressure test/bypass valve of the present invention in three positions.
Figure 10B:
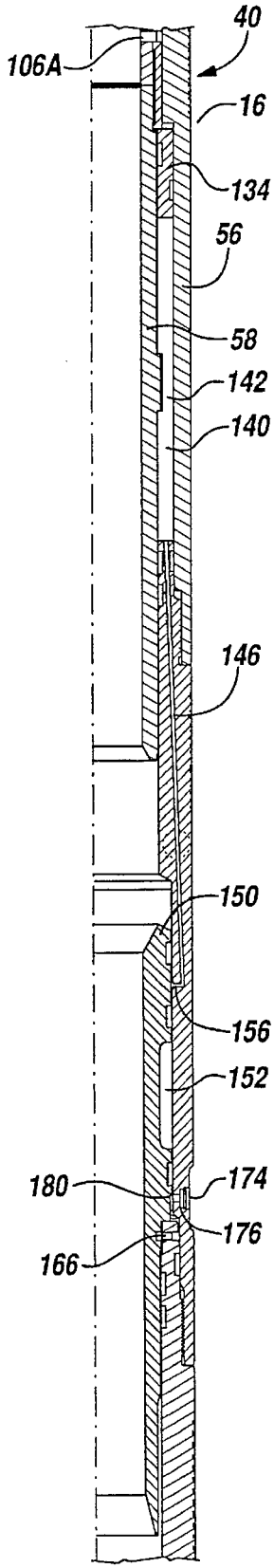
Figure 10C:
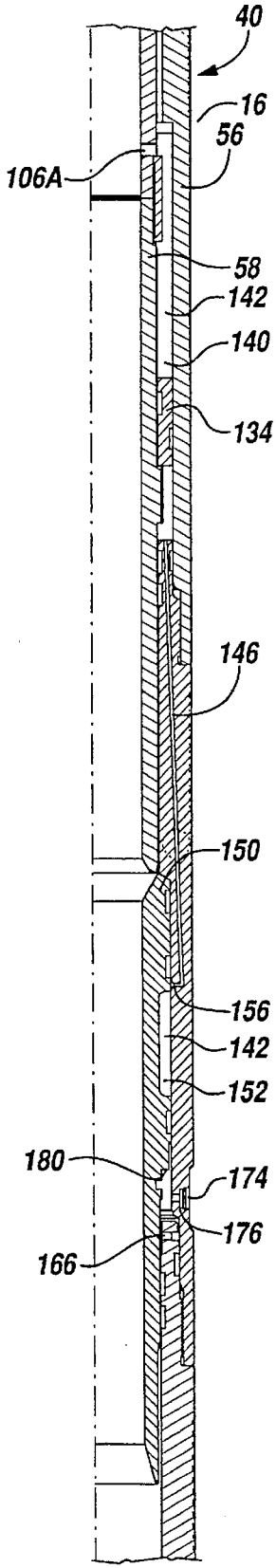

Referring to FIGS. 8–10, differential pressure test/bypass valve 40 of the present invention is run into a well bore 16 as part of a testing or other pipe string 32. As valve 40 is run in the hole, it is in the positions shown in FIGS. 8A, 9A and 10A with the operating mandrel 58 disposed in the uppermost portion of tubular housing 56, autofill ports 74 and autofill ports 76 are in separated by check valve 78, bypass ports 128 are in communication with bypass ports 130 and lower mandrel 150 is in the lowermost portion of tubular housing 56.

As the pipe string 32 continues into well bore 16 with the addition of more stands of pipe, the hydrostatic pressure of well bore 16 unseats check valve 78 placing autofill ports 74 of tubular housing 56 in communication with autofill ports 76 of operating mandrel 58 filling the inside of valve 40 and pipe string 32 with well bore fluid above ball valve 96. Pipe string 32 takes in fluid until the hydrostatic head in well bore 16 above check valve 78 no longer exceeds the hydrostatic head inside pipe string 32 whereupon check valve 78 reseats to prevent leakage from inside pipe sting 32 to well bore 16.

At any point along well bore 16 pipe string 32 may be stopped in order to perform a pressure test thereof. Pipe string 32 is pressurized by pump 42 against ball valve 96. During pressurization operating mandrel 58 slides downward relative to tubular housing 56 shouldering out on piston 134, pressurizing oil 142 in oil chamber 140 and causing noncommunication between autofill ports 76 and autofill ports 74. Pressurizing pipe string 32 also causes piston 118 to slide downward cutting off communication between bypass ports 128 and bypass ports 130. Pipe string 32 can now be pressured up to test pressure to test the integrity of pipe string 32 and the coupling of stands therein.

Assuming a successful pressure test, pressure is bled out of pipe string 32 and off of valve 40. As the pressure above ball valve 96 approaches the pressure below ball valve 96 spring 120 urges piston 118 against shoulder 122 opening communication between bypass ports 128 and bypass ports 130. As pipe string 32 continues into well bore 16. After pipe string 32 has travel down well bore 16 approximately 200 feet (depending on the density of the mud) the pressure below ball valve 96 is sufficient to cause operating mandrel 58 to slide upward relative to tubular housing 60 returning autofill ports 74 to selective communication with autofill ports 76 and allowing well bore fluid to enter valve 40 above ball valve 96 as previous explained. This pressure test process may be conducted as many times as desired.

When pipe string 32 has been run to its final depth to conduct well service or other operations, pipe string 32 may be stung into packer 48. As pipe string 32 stings into packer 48, fluid from inside pipe string 32 below ball valve 96 may pass through bypass ports 128 and bypass ports 130 to avoid damaging seal assembly 50 and packer 40. If pipe string 32 must be pulled out of packer 40, fluid from inside well bore 16 may pass through bypass ports 128 and bypass ports 130 into valve 40 to avoid a vacuum which could cause damage to seal assembly 50 and packer 48 and premature valve operation.

Once pipe string 32 is stung in packer 40 and the final pressure tests have been performed, ball valve 96 can be operated to create a blank pipe. This is achieved by maintaining a slight differential pressure above ball valve 96 the range of 100 psi. This amount of pressure is sufficient to place bypass ports 128 out of communication with bypass ports 130 by urging piston 118 against spring 120. Well bore 16 is pressurized by pump 42 and well bore fluid passes through rupture disk port 174 to upwardly urge lower mandrel 150. Lower mandrel 150 comprises a plurality of upper shoulders 180, 182, 184 such that when the well bore 16 pressure reaches 1000 psi (or other pressure as determined by the number of previously installed shear pins), shear pins 166 are sheared and lower mandrel 150 slides upward relative to tubular housing 56 placing atmospheric air chamber 152 in communication with oil discharge port 148. High pressure oil 142 travels from oil chamber 140 through internal passageway 146 into atmospheric air chamber 152.

Piston 134 no longer sees pressure from high pressure oil 142 below but continues to see the same pressure from above that exists below ball valve 96 as this pressure enters through ports 106A and tubular housing 56 down to piston 134 which now downwardly urges operating mandrel 58. Pressurized well bore fluid also travels through surface test ports 100 communicating with lower shoulder 102 of operating mandrel 58 thereby downwardly urging operating mandrel 58. The pressure in pipe string 32 above ball valve 96 is also downwardly urging operating mandrel 58. As the combined force of these three mechanisms far exceeds the retaining ability of shear pins 110 they are sheared allowing operating mandrel 58 to slide downwardly relative to tubular housing 60. As operating mandrel 58 slides downward shear pin holder 108 shoulders out on lower shoulder 116 creating relative motion between ball valve operator 98 and operating mandrel 58 causing ball valve 96 to rotate to an permanently open position. Shear pins 110 are radially urged by spring 112 so that when shear pin receiver 113 reaches sheared shear pins 110 as operating mandrel 58 slides downward, shear pins 110 engage shear pin receiver 113 permanently locking ball valve 96 in an open condition. As autofill ports 74 and autofill ports 76 are permanently out of communication and as bypass ports 128 and bypass ports 130 are permanently out of communication and as ball valve 96 is permanently open, valve 40 becomes a blank pipe.

In an alternate embodiment, rupture disk 176 is placed in rupture disk port 174 before valve 40 is run into well bore 16. Once pipe string 32 is stung into packer 40 and the final pressure tests have been performed, well bore 16 must be pressurized by pump 42 so that the absolute pressure (hydrostatic head plus applied pressure) in well bore 16 at the level of rupture disk 176 reaches a specified pressure such as 12,000 psi. Once rupture disk 176 bursts, the operation of valve 40 is as specified above.

It is therefore apparent that the apparatus and method for use of the same has inherent advantages over the prior art. While certain preferred embodiments of the invention have been illustrated for the purpose of this disclosure, numerous changes in the arrangement and construction of parts may be made by those skilled in the art, which changes are embodied within the scope and spirit of the present invention as defined by the appended claims.

What is claimed is:

1. A well tool apparatus comprising:

a tubular housing;

an operating mandrel slidably disposed within said tubular housing having an upper section and a lower section;

a ball valve rotatably disposed within said operating mandrel, said ball valve being normally closed such that there is no internal communication between said upper section of said operating mandrel and said lower section of said operating mandrel so that differential pressure can be maintained across said ball valve; and a lower mandrel slidably disposed within said tubular housing below said operating mandrel such that when said lower mandrel slides upwardly relative to said tubular housing, said operating mandrel slides downwardly relative to said tubular housing and said ball valve is rotatably operated, thereby creating a blank pipe.

2. The well tool apparatus as recited in claim 1, wherein said tubular housing defines at least one autofill port and said operating mandrel defines at least one autofill port, said at least one autofill port in said tubular housing is selectively in communication with said at least one autofill port in said operating mandrel.

3. The well tool apparatus as recited in claim 2, further comprising a check valve disposed between said operating mandrel and said tubular housing to selectively place said at least one autofill port in said tubular housing out of communication with said at least one autofill port in said operating mandrel.

4. The well tool apparatus as recited in claim 1, wherein said tubular housing defines at least one bypass port and said operating mandrel defines at least one bypass port, said at least one bypass port in said tubular housing is selectively in communication with said at least one bypass port in said operating mandrel.

5. The well tool apparatus as recited in claim 1, wherein said lower mandrel and said tubular housing form an atmospheric air chamber therebetween.

6. The well tool apparatus as recited in claim 5, wherein said operating mandrel and said tubular housing form an oil chamber therebetween having high pressure oil therein.

7. The well tool apparatus as recited in claim 6, wherein said tubular housing comprises at least one rupture disk port.

8. The well tool apparatus as recited in claim 1, wherein said tubular housing comprises an internal passageway having an oil discharge port.

9. The well tool apparatus as recited in claim 8, wherein said lower mandrel comprises at least one upper shoulder and at least one lower shoulder, said at least one upper shoulder having a greater surface area than said at least one lower shoulder such that when sufficient annular pressure passes through said at least one rupture disk port said lower mandrel slides upward relative to said tubular housing placing said air chamber in communication with said oil discharge port allowing said high pressure oil from said oil chamber to discharge into said atmospheric air chamber allowing said operating mandrel to slide downwardly relative to said tubular housing such that said ball valve is rotatably operated, thereby creating a blank pipe.

10. The well tool apparatus as recited in claim 7, further comprising a rupture disk disposed within said rupture disk port, said rupture disk operating at a predetermined absolute annular pressure.

11. A well tool apparatus comprising:

a tubular housing having an upper portion defining at least one autofill port and having a lower portion defining at least one bypass port, at least one rupture disk port, and an internal passageway terminating in an oil discharge port;

an operating mandrel slidably disposed within said tubular housing having an upper section defining at least one autofill port and a lower section defining at least one bypass port, said operating mandrel defining a chamber;

a check valve disposed within said chamber of said operating mandrel;

means for operating said check valve such that said at least one autofill port in said operating mandrel is selectively in communication with said at least one autofill port in said tubular housing, thereby substantially equalizing the differential pressure across said check valve;

a ball valve rotatably disposed within said operating mandrel below said at least one autofill port of said operating mandrel and above said at least one bypass port of said operating mandrel, said ball valve being normally closed preventing internal communication between said upper section of said operating mandrel and said lower section of said operating mandrel so that differential pressure can be maintained across said ball valve;

means for downwardly urging said operating mandrel such that said at least one autofill port in said operating mandrel and said at least one autofill port in said tubular housing are no longer in communication and such that said at least one bypass port in said tubular housing and said at least one bypass port in said operating mandrel are no longer in communication;

means for placing said at least one bypass port in said operating mandrel in communication with said at least one bypass port of said tubular housing;

means for upwardly urging said operating mandrel relative to said tubular housing placing said at least one autofill port in said operating mandrel in selective communication with said at least one autofill port in said tubular housing;

a lower mandrel slidably disposes within said lower portion of said tubular housing below said bypass port in said tubular housing;

means for upwardly urging said lower mandrel within said tubular housing toward said operating mandrel; and means for activating said operating mandrel such that said operating mandrel slides downwardly relative to said tubular housing, said at least one autofill port in said operating mandrel and said at least one autofill port in said tubular housing are permanently out of communication, said at least one bypass port in said tubular housing and said at least one bypass port in said operating mandrel are permanently out of communication and said ball valve is rotatably operated, thereby creating a blank pipe.

12. The well tool apparatus as recited in claim 11, wherein said means for operating said check valve comprises a spring disposed between said upper section of said operating mandrel and said tubular housing, said spring upwardly biasing said check valve to a normally closed position, said check valve opening responsive to annular pressure sufficiently greater than the pressure inside said upper section of said operating mandrel, thereby substantially equalizing the differential pressure across said check valve.

13. The well tool apparatus as recited in claim 11, wherein said means for placing said at least one bypass port in said operating mandrel in communication with said at least one bypass port of said tubular housing comprises a spring disposes between said lower section of operating mandrel and said tubular housing and a piston slidably disposed between said operating mandrel and said tubular housing, said piston being upwardly biased by said spring in said lower section of said operating mandrel.

14. The well tool apparatus as recited in claim 11, wherein said means for downwardly urging said operating mandrel comprises creating differential pressure across said ball valve such that the pressure above said ball valve is sufficiently greater than the pressure below said ball valve.

15. The well tool apparatus as recited in claim 11, wherein said means for upwardly urging said operating mandrel comprises creating differential pressure across said ball valve such that the pressure below said ball valve is sufficiently greater than the pressure above said ball valve.

16. The well tool apparatus as recited in claim 11, wherein said means for upwardly urging said operating mandrel comprises pressurizing below said ball valve with annular pressure through said at least one bypass port of said operation mandrel and said at least one bypass port of said tubular housing.

17. The well tool apparatus as recited in claim 11, wherein said means for upwardly urging said lower mandrel comprises at least one upper shoulder and at least one lower shoulder being integral with said lower mandrel, said at least one upper shoulder having a greater surface area than said at least one lower shoulder such that communication between said at least one upper shoulder and said at least one lower shoulder with annular pressure through said rupture disk port upwardly urges said lower mandrel.

18. The well tool apparatus as recited in claim 11, further comprising a rupture disk disposed within said rupture disk port, said rupture disk operating at a predetermined absolute annular pressure.

19. The well tool apparatus as recited in claim 11, wherein said means for activating said operating mandrel comprises at least one upper shoulder and at least one lower shoulder being integral with said lower mandrel, wherein said lower mandrel and said tubular housing form an atmospheric air chamber therebetween, wherein said operating mandrel and said tubular housing form an oil chamber therebetween having high pressure oil therein, and wherein said at least one upper shoulder of said lower mandrel has a greater surface area than said at least one lower shoulder of said lower mandrel such that when sufficient annular pressure passes through said at least one rupture disk port said lower mandrel slides upward relative to said tubular housing placing said air chamber in communication with said oil discharge port allowing said high pressure oil from said oil chamber to discharge into said atmospheric air chamber allowing said operating mandrel to slide downwardly relative to said tubular housing such that said at least one autofill port in said operating mandrel and said at least one autofill port in said tubular housing are permanently out of communication and such that said at least one bypass port in said tubular housing and said at least one bypass port in said operating mandrel are permanently out of communication and such that said ball valve is rotatably operated, thereby creating a blank pipe.

20. A well tool apparatus comprising:

a tubular housing;

an operating mandrel having a first section and a second section, said operating mandrel slidably disposed within said tubular housing;

a valve disposed within said operating mandrel between said first section and said second section, said valve being normally closed for preventing internal communication between said first section of said operating mandrel and said second section of said operating mandrel so that differential pressure can be maintained across said valve; and a lower mandrel slidably disposed within said tubular housing proximate said second section of said operating mandrel such that when said lower mandrel slides relative to said tubular housing, said operating mandrel slides relative to said tubular housing operating said valve to an open position.

21. The well tool apparatus as recited in claim 20, wherein said lower mandrel and said tubular housing form an air chamber therebetween having low pressure air therein.

22. The well tool apparatus as recited in claim 21, wherein said operating mandrel and said tubular housing form an oil chamber therebetween having high pressure oil therein.

23. The well tool apparatus as recited in claim 22, wherein said tubular housing comprises at least one rupture disk port.

24. The well tool apparatus as recited in claim 23, wherein said tubular housing defines an internal passageway in communication with said oil chamber, said internal passageway terminating in an oil discharge port.

25. The well tool apparatus as recited in claim 24, wherein said lower mandrel comprises first and second shoulders, said first shoulder having a greater surface area than said second shoulder such that when sufficient pressure from said well bore passes through said at least one rupture disk port, said lower mandrel slides relative to said tubular housing placing said air chamber in communication with said oil discharge port allowing said high pressure oil from said oil chamber to discharge into said air chamber and allowing said operating mandrel to slide relative to said tubular housing such that said valve is operated to said open position.

26. A well tool apparatus comprising:

a tubular housing;

an operating mandrel having a first section and a second section, said operating mandrel slidably disposed within said tubular housing;

a valve disposed within said operating mandrel between said first section and said second section, said valve being normally closed for preventing internal communication between said first section of said operating mandrel and said second section of said operating mandrel so that differential pressure can be maintained across said valve, said valve being a ball valve that is rotatably disposed within said operating mandrel.

27. A well tool apparatus comprising:

a tubular housing defining at least one autofill port;

an operating mandrel having a first section and a second section, said operating mandrel slidably disposed within said tubular housing, said first section of said operating mandrel defining at least one autofill port, said at least one autofill port in said tubular housing being in selective communication with said at least one autofill port in said first section of said operating mandrel; and a valve disposed within said operating mandrel between said first section and said second section, said valve being normally closed for preventing internal communication between said first section of said operating mandrel and said second section of said operating mandrel so that differential pressure can be maintained across said valve.

28. The well tool apparatus as recited in claim 27, further comprising a check valve operably disposed between said at least one autofill port of said operating mandrel and said at least one autofill port of said tubular housing.

29. A well tool apparatus comprising:

a tubular housing defining at least one bypass port;

an operating mandrel having a first section and a second section, said operating mandrel slidably disposed within said tubular housing, said second section of said operating mandrel defining at least one bypass port, said at least one bypass port in said tubular housing being in selective communication with said at least one bypass port in said second section of said operating mandrel; and a valve disposed within said operating mandrel between said first section and said second section, said valve being normally closed for preventing internal communication between said first section of said operating mandrel and said second section of said operating mandrel so that differential pressure can be maintained across said valve.

30. A method for pressure testing a pipe string in a well bore, comprising:

providing a well tool apparatus for use in said pipe string, said well tool apparatus comprising a tubular housing, an operating mandrel slidably disposed within said tubular housing and a valve operably disposed within said operating mandrel, said operating mandrel having a first section and a second section, said valve located between said first section and said second section;

running said pipe string into said well bore;

applying pressure within said pipe string and within said first section of said operating mandrel against said valve;

sliding said operating mandrel relative to said tubular housing;

testing the integrity of said pipe string by applying a testing pressure within said pipe string and within said first section of said operating mandrel against said valve;

releasing said testing pressure;

applying pressure within said second section of said operating mandrel against said valve; and sliding said operating mandrel relative to said tubular housing.

31. The method as recited in claim 30, wherein the step of applying pressure within said pipe string and within said first section of said operating mandrel against said valve further comprises filling said pipe string with fluid from said well bore by selectively communicating at least one autofill port in said tubular housing with at least one autofill port in said first section of said operating mandrel.

32. The method as recited in claim 30, wherein the step of applying pressure within said second section of said operating mandrel against said valve further comprises running said pipe string further into said well bore and filling said second section with fluid from said well bore by communicating at least one bypass port in said tubular housing with at least one bypass port in said second section of said operating mandrel.

33. The method as recited in claim 30 further comprising the steps of:

sliding a lower mandrel disposed within said tubular housing relative to said tubular housing;

sliding said operating mandrel relative to said tubular housing to a locking position; and operating said valve to an open position.

34. The method as recited in claim 33, wherein the step of sliding a lower mandrel relative to said tubular housing further comprises increasing the pressure in said well bore and communicating said pressure from said well bore with said lower mandrel through at least one check valve port in said tubular housing.

35. The method as recited in claim 33, wherein the step of sliding said operating mandrel relative to said tubular housing to a locking position further comprises communicating high pressure oil from an oil chamber disposed between said operating mandrel and said tubular housing with an air chamber disposed between said lower mandrel and said tubular housing, discharging said high pressure oil into said air chamber and communicating well bore pressure with said operating mandrel through at least one surface test port in said tubular housing.

* * * * *